US007849564B2

(12) United States Patent
Miller

(10) Patent No.: US 7,849,564 B2
(45) Date of Patent: Dec. 14, 2010

(54) PIVOTING SUPPORT HANDLE

(75) Inventor: F. Troy Miller, Logan, UT (US)

(73) Assignee: Stander Inc., Logan, UT (US)

( * ) Notice: Subject to any disclaimer, the term of this patent is extended or adjusted under 35 U.S.C. 154(b) by 881 days.

(21) Appl. No.: 11/653,494

(22) Filed: Jan. 16, 2007

(65) Prior Publication Data

US 2007/0251053 A1 Nov. 1, 2007

Related U.S. Application Data

(60) Provisional application No. 60/795,299, filed on Apr. 27, 2006.

(51) Int. Cl.
*B25G 1/10* (2006.01)

(52) U.S. Cl. ..... 16/436; 16/438

(58) Field of Classification Search ..... 16/436, 16/438, 430; 248/131, 132, 200, 200.1, 218.4, 248/157, 159, 410; 5/662, 81.1 R, 87.1; 4/504, 571.1, 576.1, 667
See application file for complete search history.

(56) References Cited

U.S. PATENT DOCUMENTS 1,797,911 A * 3/1931 Goenen et al. ..... 297/358
4,101,036 A * 7/1978 Craig ..... 211/107
4,725,027 A * 2/1988 Bekanich ..... 248/125.8
4,932,090 A * 6/1990 Johansson ..... 5/662
5,366,191 A * 11/1994 Bekanich ..... 248/125.1
5,586,352 A * 12/1996 O'Brien et al. ..... 5/662
5,906,284 A * 5/1999 Hammerstrom et al. ..... 211/205
5,979,854 A * 11/1999 Lundgren et al. ..... 248/354.3
6,012,182 A * 1/2000 Allen et al. ..... 5/81.1 R
6,068,225 A * 5/2000 O'Brien et al. ..... 248/200.1
6,560,794 B2 * 5/2003 Allen et al. ..... 5/81.1 R

FOREIGN PATENT DOCUMENTS

DE 1805421 B * 7/1976

OTHER PUBLICATIONS

HealthCraft Dependa-Bar (installation instructions); HealthCraft Products Inc., Ottawa, Ontario, Canada. Copyright 2006. (3 pgs) http://www.healthcraftproducts.com.
HealthCraft Dependa-Bar (website download); HeathCraft Products Inc., Ottawa, Ontario, Canada. (7 pgs) http://web.archive.org/web/20051030030453/http://www.healthcraftproducts.com/dependabar.htm (Oct. 30, 2005).

* cited by examiner

*Primary Examiner*—Chuck Y. Mah
(74) *Attorney, Agent, or Firm*—Stoel Rives LLP

(57) ABSTRACT

A mobility assistance device for providing support to a user is disclosed. The mobility assistance device may include a handle having a plurality of rungs to be grasped by a user. The handle may be pivoted to various support positions as desired.

17 Claims, 10 Drawing Sheets

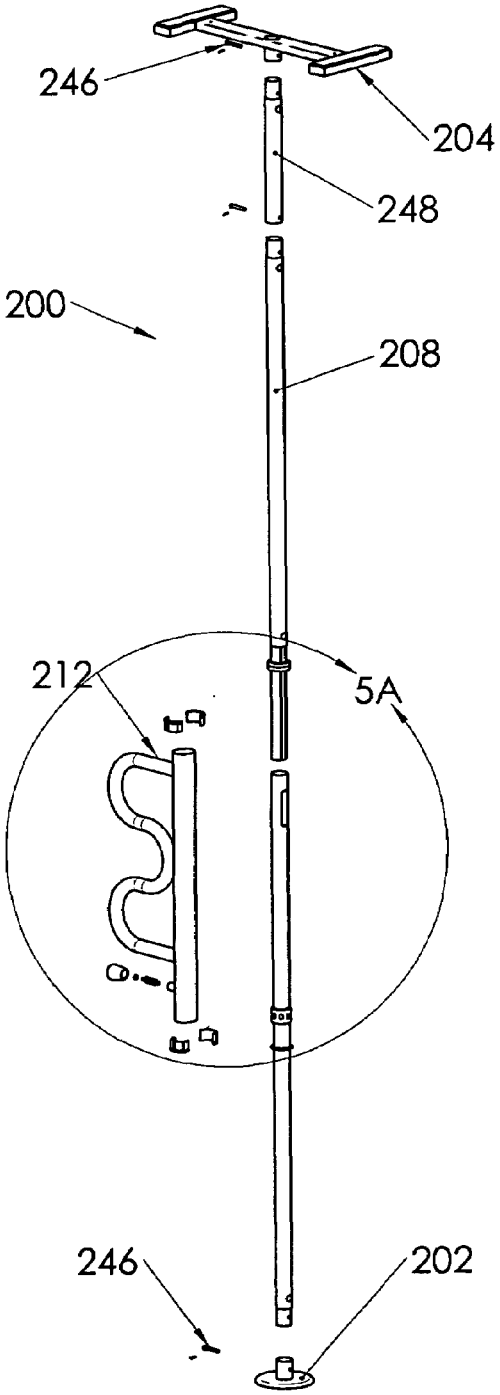
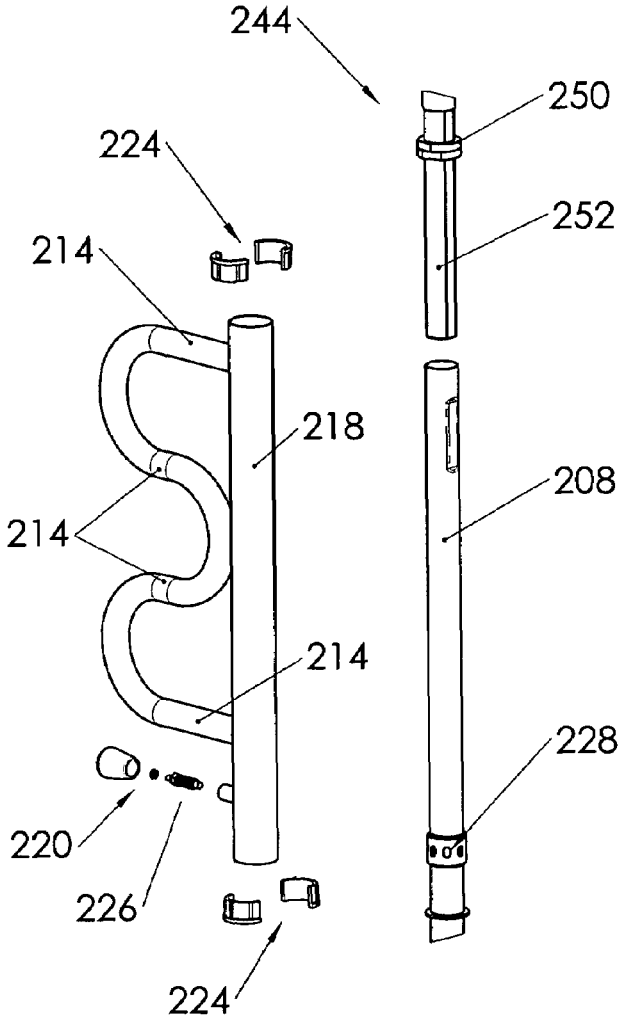
FIGURE 5A
FIGURE 5

PIVOTING SUPPORT HANDLE

RELATED APPLICATIONS

This application claims the benefit under 35 U.S.C. §119 (e) of U.S. Provisional Patent Application No. 60/795,299, filed Apr. 27, 2006, and titled "Wall Mounted Support Device," which is incorporated herein by reference.

TECHNICAL FIELD

The present disclosure relates generally to mobility assistance devices. More specifically, the present disclosure relates to assistance devices that can assist individuals in moving about a room and/or positioning themselves into and out of sitting positions from beds, chairs, toilets, and other similar furniture and devices.

BRIEF DESCRIPTION OF THE DRAWINGS

The present embodiments will become more fully apparent from the following description and appended claims, taken in conjunction with the accompanying drawings. Understanding that the accompanying drawings depict only typical embodiments, and are, therefore, not to be considered to be limiting of the scope of the present disclosure, the embodiments will be described and explained with specificity and detail in reference to the accompanying drawings as provided below.

FIG. 5 is an exploded perspective view of the mobility assistance device of FIG. 4.

FIG. 5A is an exploded detail view of portion A of the mobility assistance device of FIG. 5.

DETAILED DESCRIPTION

It will be readily understood that the components of the embodiments as generally described, and illustrated in the Figures herein, could be arranged and designed in a wide variety of different configurations. Thus, the following more detailed description of various embodiments, as represented in the Figures, is not intended to limit the scope of the disclosure, but is merely representative of various embodiments. While the various aspects of the embodiments are presented in drawings, the drawings are not necessarily drawn to scale unless specifically indicated.

The phrases "connected to," "coupled to" and "in communication with" refer to any form of interaction between two or more entities, including mechanical, electrical, magnetic, electromagnetic, fluid, and thermal interaction. Two components may be coupled to each other even though they are not in direct contact with each other. For example, two components may be coupled to each other through an intermediate component.

Figure 1:
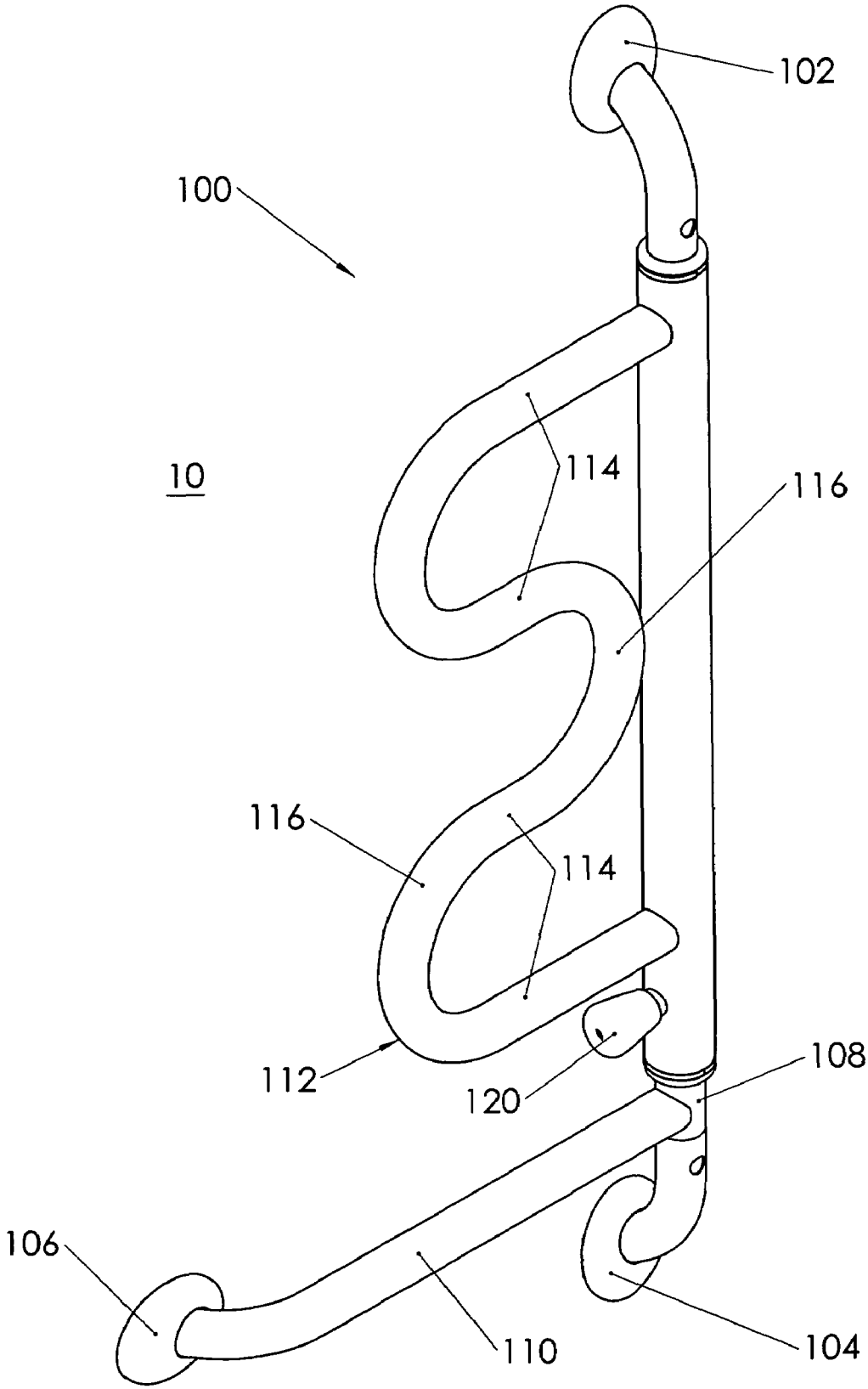
FIG. 1 is a perspective view of one embodiment of a mobility assistance device mountable on a wall.

FIG. 1 represents one embodiment of a mobility assistance device 100 as shown from a perspective view. Mobility assistance devices are typically used to assist individuals with disabilities and/or other infirmities that may be incident to accidents, disease, age or similar causes. Mobility assistance devices are designed to help these individuals get around a room and/or into and out of reclining, sitting and/or prone positions on beds, chairs, toilets, and other similar furniture.

The mobility assistance device 100 depicted in FIG. 1 is coupled to a surface 10 such as a wall through first 102, second 104 and third 106 mounting brackets. In alternative embodiments only one or two mounting brackets may be required, or alternatively, more than three mounting brackets may be used depending upon the support required for the particular application. The mobility assistance device 100 may be mounted in a bathroom adjacent a toilet, bathtub or shower as would benefit the user. Alternatively, the mobility assistance device 100 may be mounted adjacent a bed to assist a user's ingress and egress there from. Other mounting locations would be appreciated by those having skill in the art with the aid of the present disclosure.

According to the embodiment depicted, a first support member 108 extends between the first 102 and second 104 mounting brackets in a substantial vertical direction relative to the floor. The first support member 108 may include a rod and/or additional components as will be described in greater detail in conjunction with FIG. 2. While the support member 108 may comprise a single integrated unit in alternative embodiments, such as the embodiment of FIG. 1, the support member 108 may comprise a series of components that are coupled together to provide the structural support for the mobility assistance device 100.

The mobility assistance device 100 also includes a second support member 110 which is coupled to the third mounting bracket 106. The second support member 110 extends in a horizontal direction relative to the floor, and is coupled to the first support member 108 in an orthogonal orientation. The second support member 110 acts as a reinforcing brace which provides additional support when a user applies a force to the device 100. The additional brace helps prevent the first 102 and second 104 mounting brackets from pulling away from the wall 10 when a user pulls or pushes against the device 100. Additionally, the second support member 100 may be grasped by a user as a support rail in positioning.

The mobility assistance device 100 also comprises a curved handle 112 that includes four horizontal rungs 114 that operate as hand grip portions that extend substantially horizontal relative to the floor. Alternative embodiments may use three rungs, or more than four as desired. The horizontal portion of the rungs 114 are parallel to each other, and are disposed in a series in the vertical direction. Accordingly, the handle 112 provides a ladder-like structure which users can grasp to pull themselves to a standing position, or alternatively to move into a sitting position.

In the embodiment of FIG. 1, the rungs 114 of the handle 112 are fixed in a common plane since the rungs 114 are interconnected and form a single integrated unit. Adjacent rungs 114 are interconnected by arcuate portions 116, which also may be gripped by a user to provide support. The upper-most and lower-most rungs 114 are coupled to a sleeve 118 that circumscribes the first support member 108 that passes there through.

The sleeve 118 of the handle 112 is pivotally and rotatably coupled to the first support member 108 along a substantially common axis. In the embodiment shown, the ends of the upper-most and lower-most rungs 114 intersect the first support member 108 in an orthogonal orientation. In alternative embodiments, the upper-most and lower-most rungs 114 may turn to intersect the first support member 108 in a parallel or collinear orientation. In yet further embodiments, the rung ends may intersect the first support member 108 at an acute or obtuse angle.

In the embodiment of FIG. 1, the curved handle 112 is tubular in shape to facilitate gripping by a user. However, alternative shapes may be utilized as would be apparent to one having skill in the art with the aid of the present disclosure, such as having an octagonal or other polygonal cross sectional shape.

The mobility assistance device 100 also includes a locking mechanism 120 for maintaining the handle 112 in a defined support position. When disengaged, the locking mechanism 120 allows the handle to pivot and rotate collinearly about the first support member 108 to a different support position. Consequently, the locking mechanism 120 functions as a pivot mechanism for permitting the handle 112 to pivot into a plurality of positions. The locking mechanism 120 may be configured to restrict movement of the handle 112 in the vertical direction to prevent slippage or jarring that could cause a user to come off balance when the user applies a force in an upward or downward direction.

Figure 2:
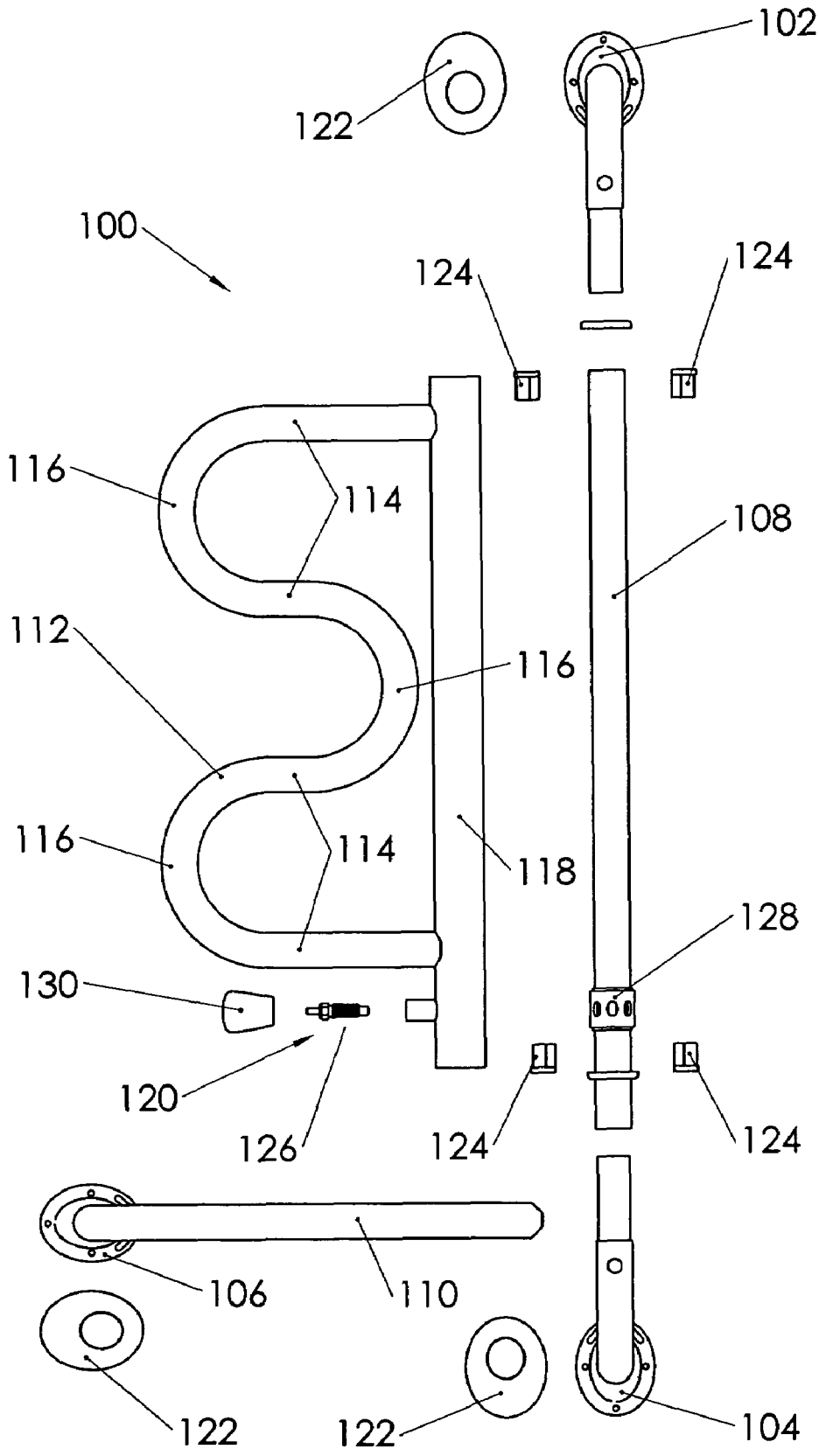
FIG. 2 is an exploded side elevation view of the mobility assistance device of FIG. 1.

FIG. 2 depicts the mobility assistance device 100 of FIG. 1 from an exploded side elevation view. As described above, the device 100 includes first 102, second 104 and third 106 mounting brackets for mounting the device 100 to a wall or similar surface. Mounting bracket covers 122 may be used to provide an aesthetically pleasing appearance to the mounting locations of the device 100, and also may cover rough edges that may result through the use of fasteners (not shown).

The mobility assistance device 100 also comprises a vertical first support member 108, such as a rod, and a horizontal second support member 110 to provide additional structural support. By way of example, the second support member 110 may optionally have a length of about sixteen inches.

The device 100 also includes a handle 112 for a user to grasp and to provide support. The handle 112 includes various gripping sections in the form of rungs 114 that may be interconnected through arcuate portions 116. The sleeve 118 of the handle 112 fits over the first support member 108 in a collinear arrangement. Plastic bushings 124 may be used at the ends of the sleeve 118 to facilitate the pivoting and rotational movement of the handle 112 about the support rod 108.

The locking mechanism 120 may comprise a spring pin 126 that passes through the sleeve 118 and into one of several receiving orifices 128 disposed on the first structural support 108. The spring of spring pin 126 biases the pin into one of the receiving orifices 128 to maintain the handle 112 in a defined support position. In the embodiment shown, there are eight total receiving orifices 128. However, with the wall mounted mobility assistance device 100, five of the eight orifices 128 may be used because the handle 112 may not be able to rotate through the mounting surface.

A hand knob 130 may be coupled to spring pin 126 to facilitate actuation of the locking mechanism 120. When a user wishes to pivot the handle 112, the user pulls on the hand knob 130 which disengages the spring pin 126 from the receiving orifice 128. The handle 112 may then be rotated to a different receiving orifice 128 where the spring pin 126 is biased into and maintains its locked configuration. The orientation of the locking mechanism 120, the first support member 108 and the sleeve 118 of the handle 112 prevent the handle from moving in a vertical direction during rotation.

Alternative locking mechanisms may be used, such as tab and slot arrangements that may optionally be spring biased, or a locking nut that screws down on flexible fingers. Alternative locking mechanisms in addition to those described would be appreciated by those having skill in the art with the aid of the present disclosure.

Figure 3A:
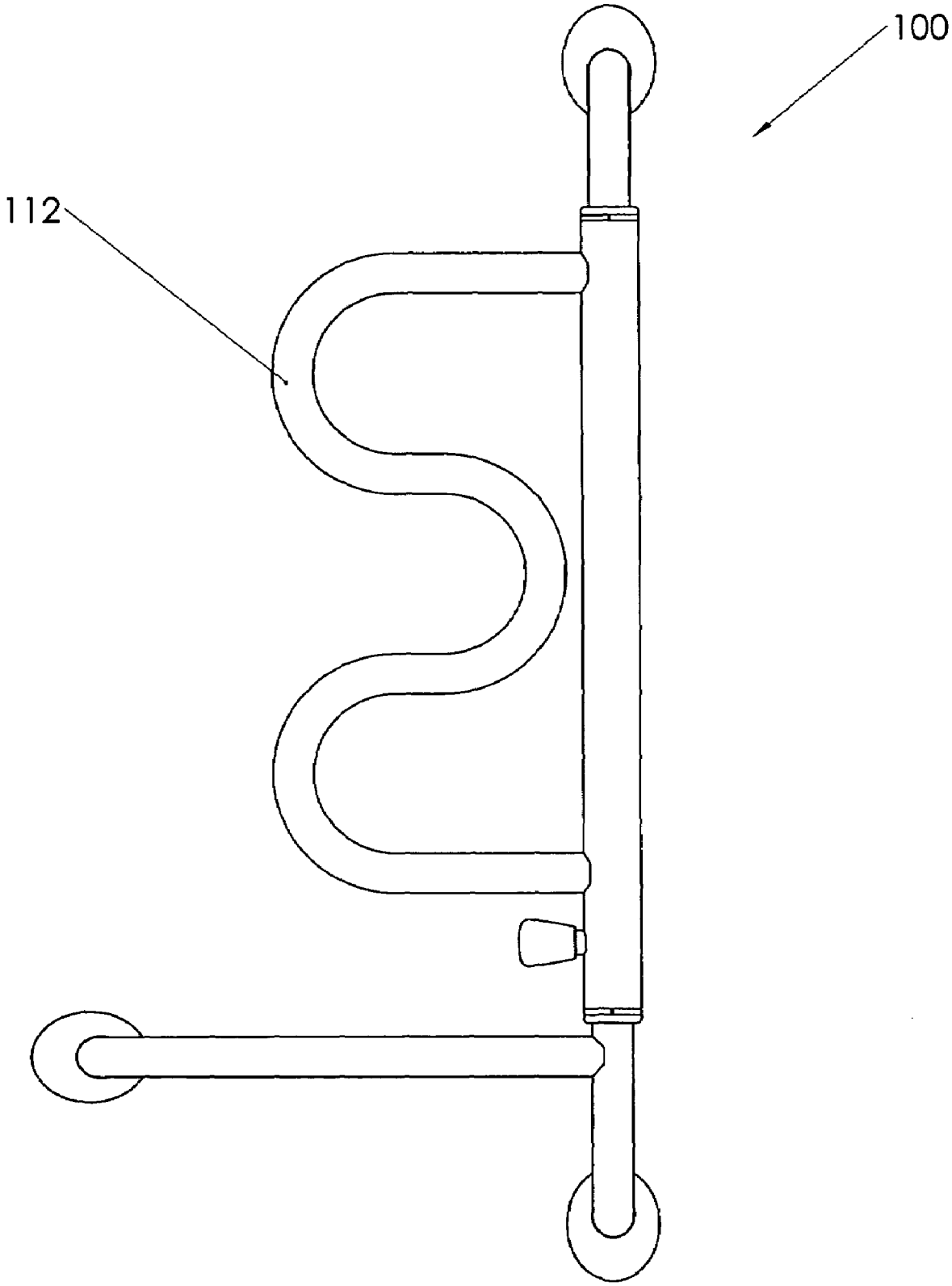
FIG. 3A is a side elevation view of the mobility assistance device of FIG. 1, where the handle is in a first position adjacent the wall.
Figure 3B:
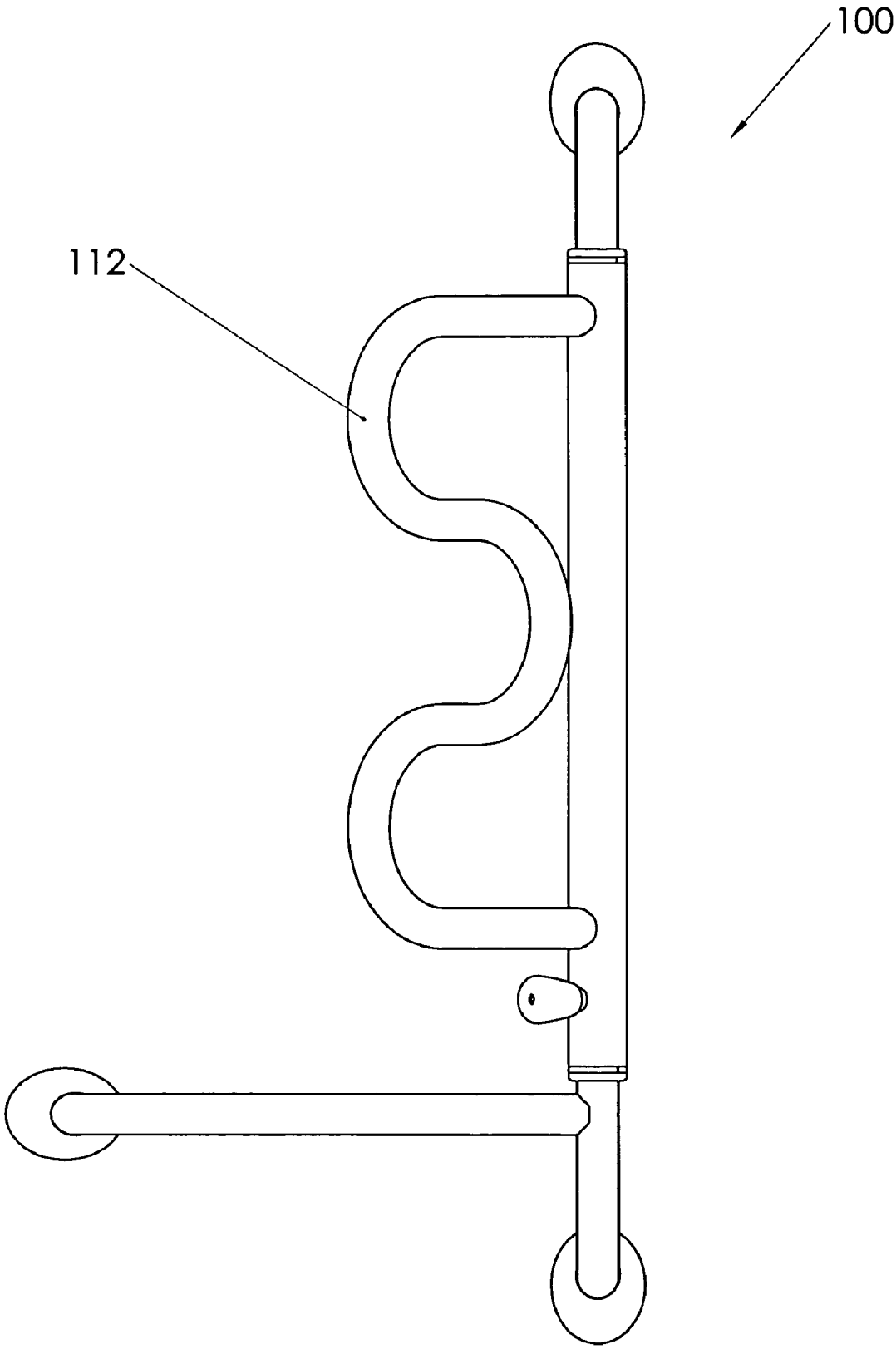
FIG. 3B is a side elevation view of the mobility assistance device of FIG. 1, where the handle is in a second position extending away from the wall.

Referring collectively to FIGS. 3A to 3E, the mobility assistance device 100 of FIG. 1 is shown in various support positions. FIG. 3A shows the handle 112 disposed in a first support position adjacent and substantially parallel to the mounting surface. FIG. 3B demonstrates how the handle 112 of the device 100 may be pivoted to a second support position at an exemplary 45 degree angle with respect to the mounting surface. The second support position coincides with the spring pin of the locking mechanism engaging a different receiving orifice than the first support position (as shown in FIG. 2).

Figure 3C:
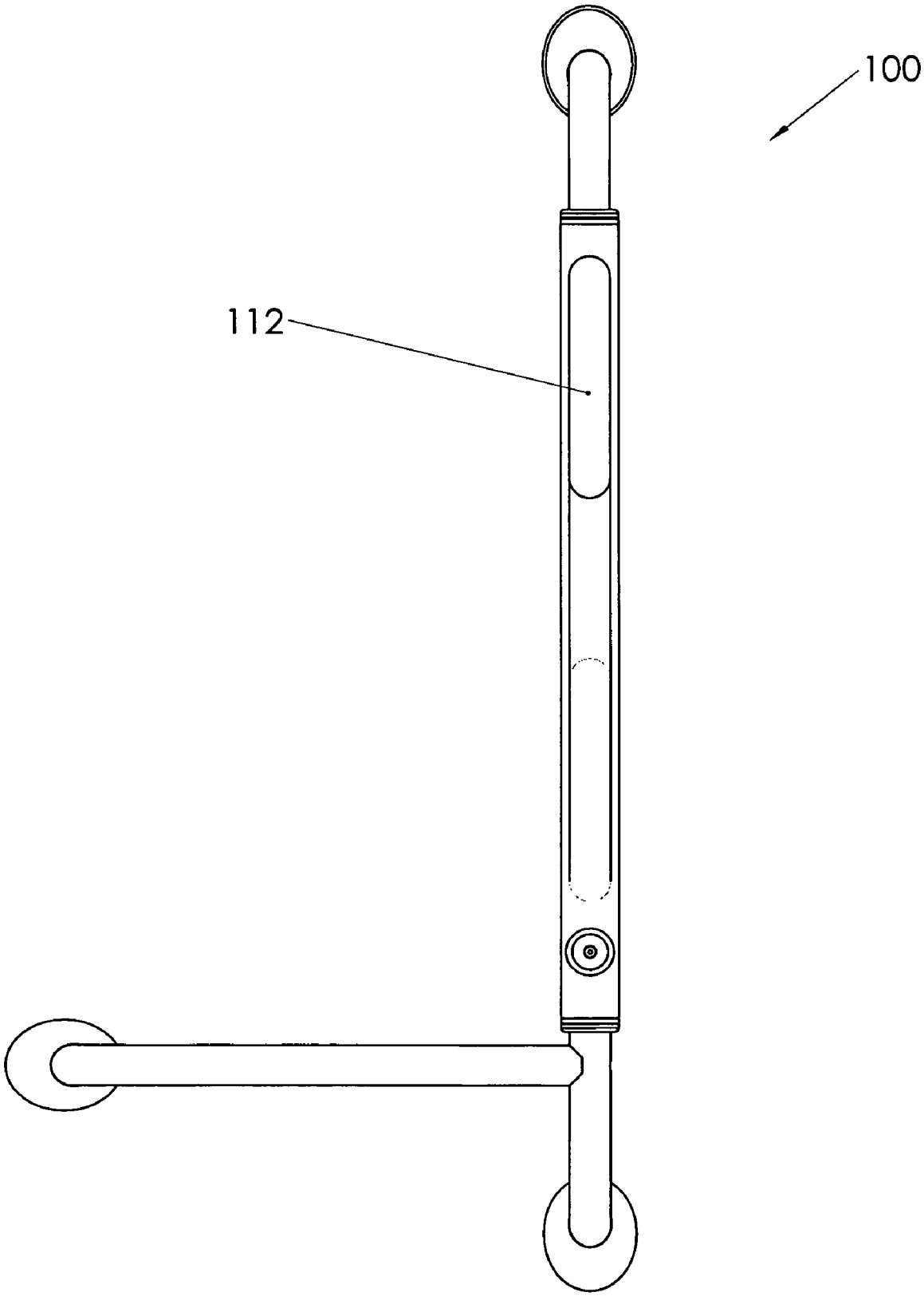
FIG. 3C is a side elevation view of the mobility assistance device of FIG. 1, where the handle is in a third position extending away from the wall.
Figure 3D:
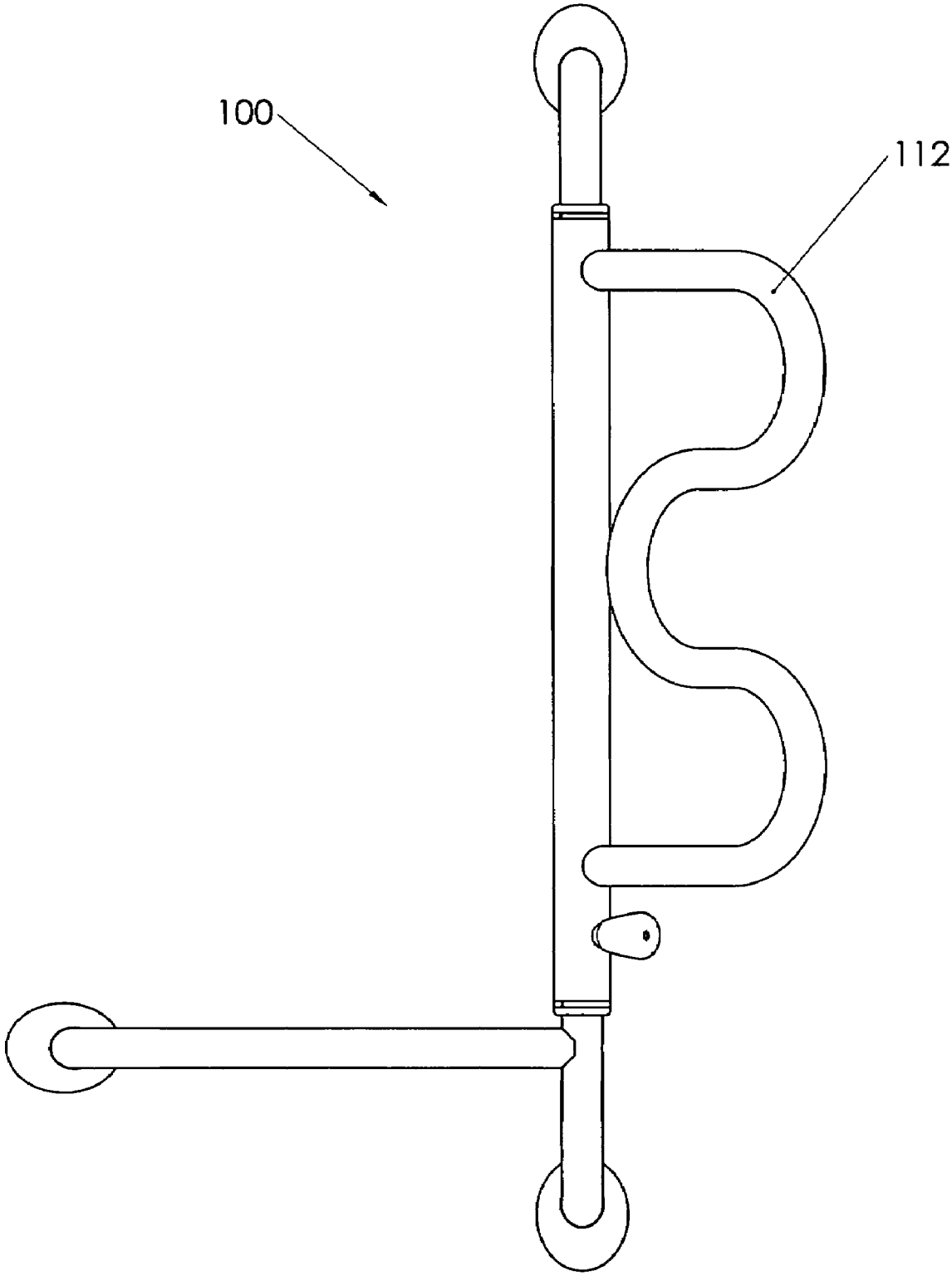
FIG. 3D is a side elevation view of the mobility assistance device of FIG. 1, where the handle is in a fourth position extending away from the wall.
Figure 3E:
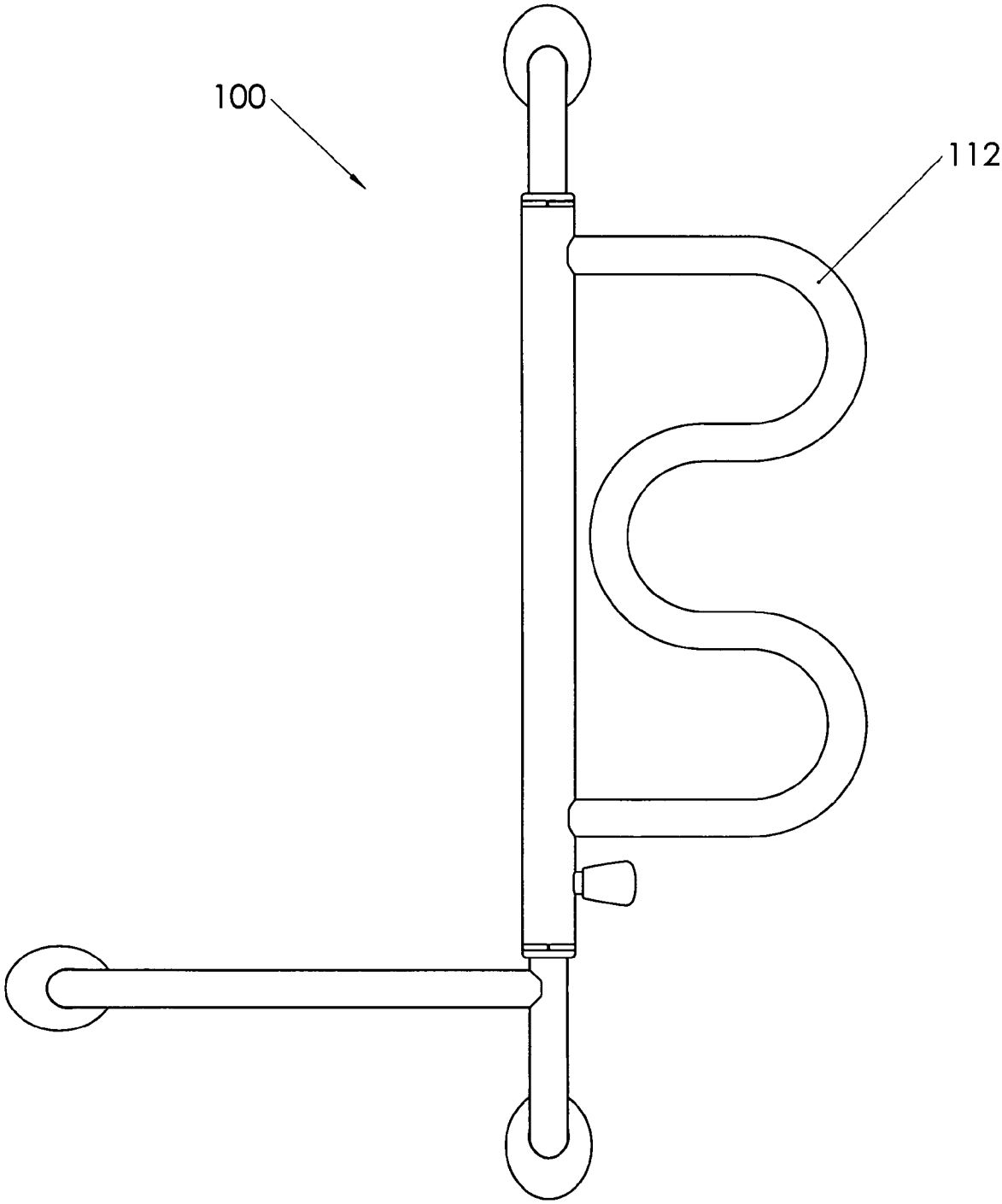
FIG. 3E is a side elevation view of the mobility assistance device of FIG. 1, where the handle is in a fifth position adjacent the wall.

FIG. 3C illustrates the handle 112 of the device 100 at a third support position which may be orthogonal to the mounting surface. FIG. 3D shows the handle 112 of the device 100 at a fourth support position which may also be disposed at about a 45 degree angle with the mounting surface (which may be orthogonal relative to the second support position). FIG. 3E represents the handle 112 of the device 100 at a fifth support position also adjacent and approximately parallel to the support surface.

Figure 4:
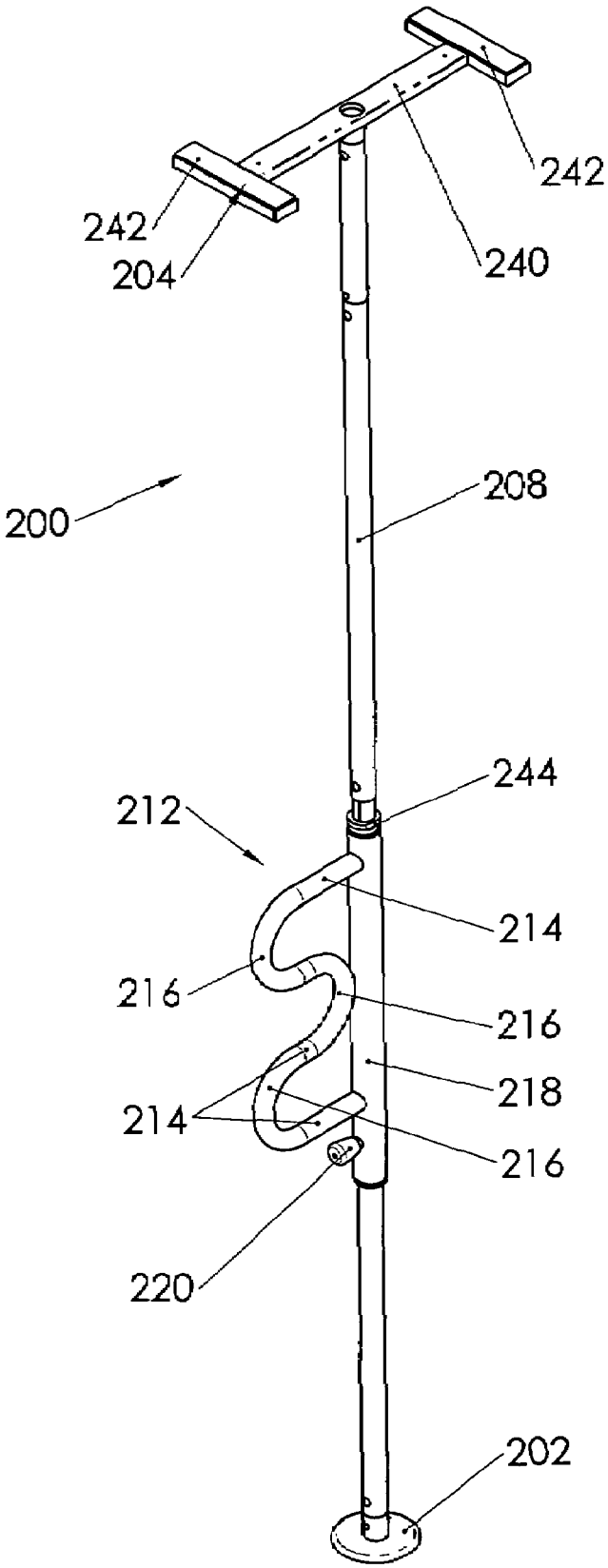
FIG. 4 is a perspective view of one embodiment of a mobility assistance device mountable between a first and second surface.
Figures 6A, 6B, 6C, 6D, 6E:
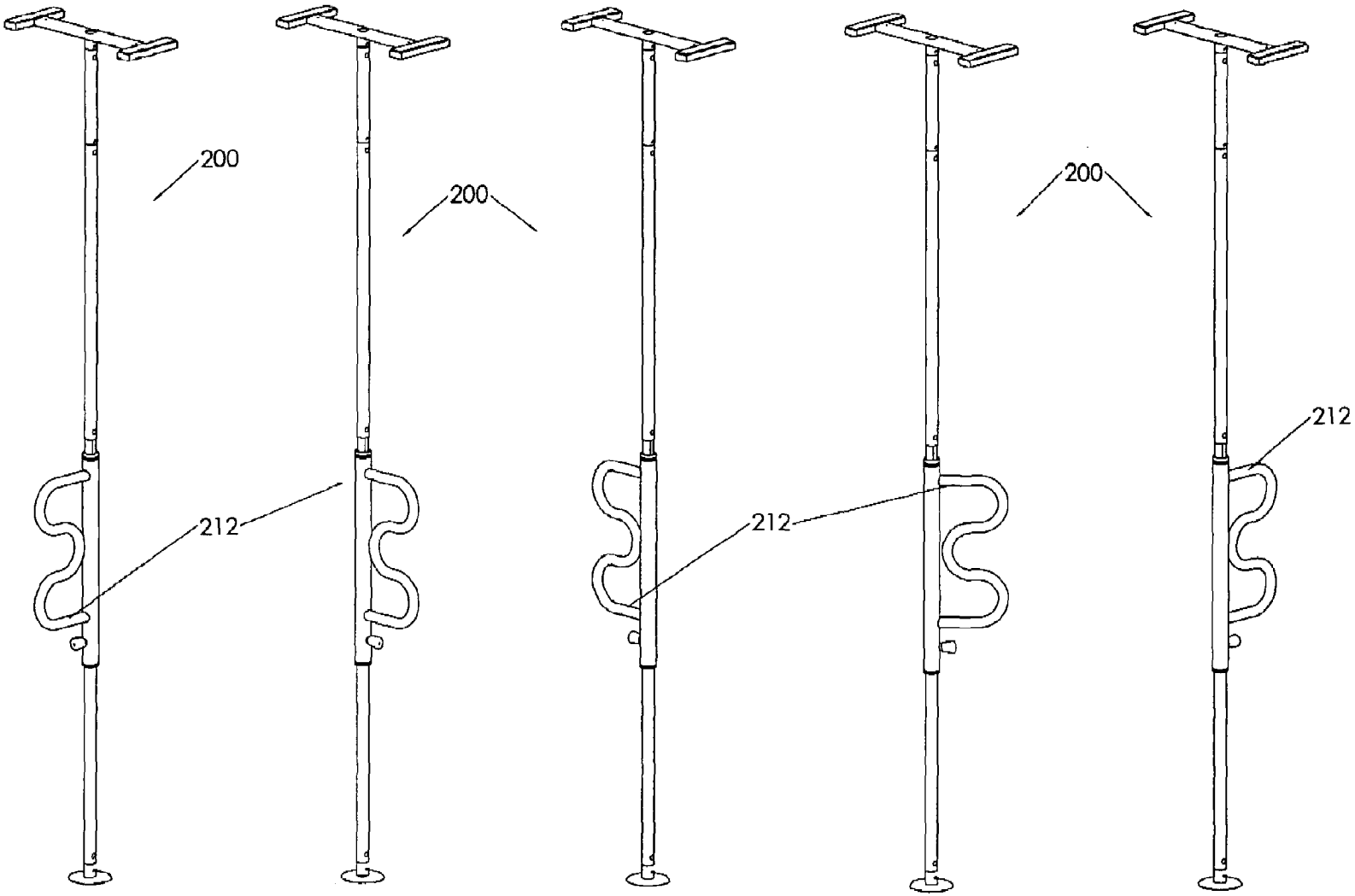
FIG. 6A is a perspective view of the mobility assistance device of FIG. 4, where in the handle is in a first position.
FIG. 6B is a perspective view of the mobility assistance device of FIG. 4, where in the handle is in a second position.
FIG. 6C is a perspective view of the mobility assistance device of FIG. 4, where in the handle is in a third position.
FIG. 6D is a perspective view of the mobility assistance device of FIG. 4, where in the handle is in a fourth position.
FIG. 6E is a perspective view of the mobility assistance device of FIG. 4, where in the handle is in a fifth position.

FIG. 4 illustrates another embodiment of a mobility assistance device 200 as shown from a perspective view. The mobility assistance device 200 includes a supporting member such as a support pole 208. A base plate 202 may be situated at one end of the support pole 208 for mounting to a floor. Mounting to a floor may include placement on a ground surface, or another base surface, such as the side of a bathtub, a shelf or similar surface that might be raised from the ground. The base plate 202 provides surface area for the support pole 208 to be stable when installing and in use. The terms "mounting" or "mounted" are not restricted to the use of fasteners, but may also encompass positioning and/or securing of the support pole 208 in a useful configuration.

A brace 204 may be situated at the opposite end of the support pole 208 from the base plate 202. The brace 204 may comprise a support beam 240 and cross members 242 to facilitate mounting to a ceiling. In the embodiment depicted, the support beam 240 and cross members 242 are arranged in a capital "I" configuration. Fasteners may optionally be used to mount the brace 204 to a ceiling.

Like the previous embodiment described, mobility assistance device 200 may include a handle 212 that comprises four horizontal rungs 214 that operate as hand grip portions and extend substantially horizontal and substantially parallel relative to the floor. As described above, alternative embodiments may use three or more than four rungs. The horizontal portion of the rungs 214 are parallel to each other, and are disposed in a series in the vertical direction. Accordingly, the handle 212 provides a ladder-like structure which users can grasp at various positions to pull themselves to a standing position, to move into a sitting position, or to maneuver about a room.

In the embodiment of FIG. 4, the rungs 214 of the handle 212 are fixed in a common plane since the rungs 214 are interconnected and form a single integrated unit. Adjacent rungs 214 are also interconnected by arcuate portions 216, which also may be gripped by a user to provide support. The upper-most and lower-most rungs 214 are coupled to a sleeve 218 that circumscribes the support pole 208 that passes there through.

Similar to the embodiment of FIGS. 1 through 3E, the sleeve 218 of the handle 212 is pivotally and rotatably coupled to the support pole 208 along a common axis. In the embodiment shown, the ends of the upper-most and lower-most rungs 214 intersect the sleeve 218 in an orthogonal orientation. Alternative arrangements as described above may also be used.

The mobility assistance device 200 also includes a locking mechanism 220 for maintaining the handle 212 in a defined support position. When disengaged, the locking mechanism 220 allows the handle to pivot about the support pole 208 to a different support position. The locking mechanism 220 may also be configured to restrict movement of the handle 212 in the vertical direction.

The mobility assistance device 200 may further include a height adjustment component 244 so that a user may alter the length of the support pole 208 in accordance with different heights between floor and ceiling in various environments. The height adjustment component 244 will be described in greater detail below.

Referring to FIGS. 5 and 5A, the mobility assistance device 200 is shown from an exploded perspective view. As described above, the device 200 includes the support pole 208 extending between floor and ceiling. A base plate 202 is located at one end of the support pole 208 and a ceiling brace 204 is located at the other end. The base plate 202 and brace 204 may be coupled to the support pole 208 via fasteners 246. The support pole 208 may also optionally include a removable height extension piece 248 that may be coupled between the support pole 208 and the brace 204. Alternatively, the removable height extension piece 248 may be coupled between the base plate 202 and the support pole 208. The height extension piece 248 may be approximately 12 inches in length such that it may be used in environments where the distance between floor to ceiling is nine feet instead of a conventional eight feet. Alternatively sized height extension pieces 248 may be used as would be appreciated by those having skill in the art with the aid of the present disclosure.

The support pole 208 may comprise a single unit, or alternatively, as shown in FIG. 5, the support pole 208 may comprise several lengths that are coupled together to form the mobility assistance device 200. The handle 212 may be located at an appropriate height near a mid-section of the support pole 208 so a user may grasp the various rungs 214 for support and positioning purposes. Plastic bushings 224 may be used at the ends of the sleeve 218 to facilitate the rotational movement of the handle 212 about the support pole 208.

The locking mechanism 220 used may comprise a spring pin 226 arrangement as described in conjunction with the previous embodiments. In the embodiment shown, there are eight total receiving orifices 228 for the spring pin 226, which correspond with eight defined support positions in which the handle 212 may be disposed. More or fewer defined support positions may be used. Alternatively, a locking mechanism permitting any degree of rotation may also be used. Also as described above, other alternative locking mechanisms may be used as would be appreciated by those having skill in the art with the aid of the present disclosure.

The height adjustment component 244 may comprise two nuts 250 that are threaded around a male threaded member 252 extending from a portion of the support pole 208 components. The nuts 250 rest on the lower portion of support pole 208 adjacent the handle sleeve 218. To adjust the height of the support pole 208, the nuts 250 are moved up or down as desired to decrease or increase the height of the support pole 208, respectively. Alternatively, a single nut 250 may be used instead of a dual-nut system as shown. Furthermore, alternative height adjustment components 244 may be used as would be appreciated by those having skill in the art with the aid of the present disclosure, such as a telescoping pole arrangement with a locking nut that screws down on flexible fingers to the desired height.

Referring collectively to FIGS. 6A to 6E, the mobility assistance device 200 of FIG. 4 is shown in various support positions. FIGS. 6A, 6B, 6C, 6D, and 6E illustrate first, second, third, fourth and fifth defined support positions of the handle 212, respectively. Each defined support position coincides with the spring pin of the locking mechanism engaging a different receiving orifice as described in conjunction with FIG. 5A. While five support positions are illustrated, the present embodiment may include eight different locations as described herein. Also as described herein, alternative numbers of defined support positions may be used or any rotational degree of position.

While specific embodiments of mobility assistance devices have been illustrated and described, it is to be understood that the disclosure provided is not limited to the precise configuration and components disclosed. Various modifications, changes, and variations, apparent to those of skill in the art, may be made in the arrangement, operation, and details of the methods and systems disclosed with the aid of the present disclosure.

Without further elaboration, it is believed that one skilled in the art can use the preceding description to utilize the present disclosure to its fullest extent. The examples and embodiments disclosed herein are to be construed as merely illustrative and exemplary and not a limitation of the scope of the present disclosure in any way. It will be apparent to those having skill in the art that changes may be made to the details of the above-described embodiments without departing from the underlying principles of the invention as claimed hereinafter. In other words, various modifications and improvements of the embodiments specifically disclosed in the description above are within the scope of the appended claims.

What is claimed is:

1. A mobility assistance device to provide support to a user, comprising:

a handle configured to be grasped by and support the user, the handle having a plurality of rungs;

a support member coupled to the handle, at least a portion of the support member extending in a first direction; and a pivot mechanism coupled to the handle and rotatably coupled to the support member permitting the handle to pivot about an axis collinear with the portion of the support member extending in the first direction, the pivot mechanism further permitting the handle to pivot and be secured into one of a plurality of positions while the handle is restricted from moving in a vertical direction, and wherein the pivot mechanism comprises a spring pin that is engageable with corresponding orifices disposed on the support member, and the handle does not move in the vertical direction when pivoting from a first position to a second position.

2. The device of claim 1, wherein the plurality of rungs are substantially parallel to each other along a portion thereof.

3. The device of claim 2, wherein the plurality of rungs comprises three or more rungs that are substantially parallel to each other along a portion thereof.

4. The device of claim 2, wherein the plurality of rungs comprises four rungs that are substantially parallel to each other along a portion thereof, and the handle comprises arcuate portions interconnecting adjacent rungs.

5. The device of claim 4, wherein the handle comprises a single piece that is shaped to provide four rungs that are substantially parallel to each other along a portion thereof.

6. The device of claim 2, wherein the plurality of rungs are configured to be orthogonal to a mounting surface, such that the mounting surface comprises a wall.

7. The device of claim 6, wherein the support member comprises two mounting points having a vertical support rod extending there between, and further comprising a third mounting point having a horizontal support rod extending therefrom to the vertical support rod.

8. The device of claim 2, wherein the plurality of rungs are configured to be parallel to a first and second mounting surface, such that the first mounting surface comprises a floor and the second mounting surface comprises a ceiling.

9. The device of claim 8, wherein the support member comprises a first mounting point configured to be mounted to the floor and a second mounting point configured to be mounted to the ceiling, the support member having a vertical support rod extending between the first and second mounting points.

10. The device of claim 9, further comprising a height adjustment component disposed on the vertical support rod adjacent the handle, the height adjustment component configured to alter the distance between the first and second mounting points.

11. The device of claim 10, wherein the second mounting point comprises a brace having a plurality of cross members.

12. The device of claim 1, wherein the pivot mechanism permits the handle to be positioned into at least five different defined support positions.

13. The device of claim 1, wherein the pivot mechanism permits the handle to be positioned into at least eight different defined support positions.

14. A mobility assistance device to provide support to a user, comprising:

a support member having a first end configured to be mounted to a ceiling and a second end configured to be mounted to a floor;

a handle rotatably coupled to the support member between first and second ends, the handle comprising:

three or more rungs that are fixed substantially parallel to each other along a portion of each rung; and arcuate portions interconnecting adjacent rungs;

a locking mechanism which locks the handle in one of a plurality of defined support positions, the locking mechanism disengageable such that the handle may rotate from one support position to another without vertical movement of the handle, and wherein the locking mechanism comprises a spring pin that is engageable with corresponding orifices disposed on the support member; and a height adjustment component disposed on the support member, the height adjustment component capable of adjusting a length of the support member between first and second ends.

15. The device of claim 14, further comprising a removable height extension piece coupled to the support member between the first and second ends.

16. The device of claim 14, wherein the height adjustment component is disposed on the support member adjacent the handle.

17. The device of claim 14, wherein the locking mechanism locks the handle in one of eight defined support positions.

* * * * *